US010456801B2

(12) United States Patent
Horning et al.

(10) Patent No.: US 10,456,801 B2
(45) Date of Patent: Oct. 29, 2019

(54) MATERIAL SPRAYER HAVING SLIDING PUMP MOUNTING

(71) Applicant: Graco Minnesota Inc., Minneapolis, MN (US)

(72) Inventors: Jeromy D. Horning, Albertville, MN (US); Thomas E. Pauly, Zimmerman, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 15/873,176

(22) Filed: Jan. 17, 2018

(65) Prior Publication Data

US 2018/0207660 A1 Jul. 26, 2018

Related U.S. Application Data

(60) Provisional application No. 62/450,806, filed on Jan. 26, 2017.

(51) Int. Cl.

*B28C 7/16* (2006.01)
*F04B 15/02* (2006.01)
*B05B 11/00* (2006.01)

(52) U.S. Cl.

CPC ..... *B05B 11/3088* (2013.01); *B28C 7/163* (2013.01); *F04B 15/023* (2013.01); *B05B 11/3001* (2013.01); *F04B 2015/026* (2013.01)

(58) Field of Classification Search

CPC ..... B05B 11/3088; B05B 7/1472; B05B 11/3001; B05B 13/005; B28C 7/163; F04B 15/023; F04B 2015/026

(Continued)

(56) References Cited

U.S. PATENT DOCUMENTS 2,388,805 A * 11/1945 Stahl ..... F23K 3/12 100/98 R
3,125,257 A * 3/1964 Vukich ..... F04B 9/1056 222/255

(Continued)

FOREIGN PATENT DOCUMENTS

CN 87211920 U 11/1988
CN 201002069 Y 1/2008

(Continued)

OTHER PUBLICATIONS

First Office Action from Chinese Patent Application No. 2018100736348, dated Jun. 4, 2019, 11 pages.

(Continued)

*Primary Examiner* — Patrick M. Buechner
*Assistant Examiner* — Michael J. Melaragno
(74) *Attorney, Agent, or Firm* — Kinney & Lange, P.A.

(57) ABSTRACT

A pump for use with a material sprayer includes a cylinder, a piston, a pump head, first and second check valves, and an elbow connected to the cylinder. The cylinder and the piston are coaxial with a pump axis. The pump head is configured to make a mechanical connection with the reciprocating drive mechanism so as to allow the reciprocating drive mechanism to reciprocate the piston along the pump axis. The elbow includes a first end, a second end, and an inner fluid channel. The first end is configured to make a fluid connection with the hopper. The second end is configured to be fixed with respect to the cylinder. The inner fluid channel extends from the first end to the second end. The pump head and the first end of the elbow are configured to make mechanical and fluid connections with a single linear motion of the pump.

20 Claims, 7 Drawing Sheets

(58) Field of Classification Search
USPC ..... 222/383.1
See application file for complete search history.

(56) References Cited

U.S. PATENT DOCUMENTS 3,128,017 A * 4/1964 Bacoka ..... A01F 25/20 222/243
3,589,567 A * 6/1971 Von Und Zu Massenbach ..... G01F 11/021 222/136
3,684,410 A * 8/1972 Fitzgerald ..... F04B 53/126 417/554
4,690,310 A * 9/1987 Rasmussen ..... G01F 11/021 222/309
5,252,037 A * 10/1993 Carlson ..... B65B 3/32 222/383.1
5,878,925 A * 3/1999 Denkins ..... B05B 7/2489 222/608
6,382,922 B1 * 5/2002 Lewis ..... E04F 21/08 417/199.1
7,114,664 B2 * 10/2006 Gundersen ..... E04F 21/12 239/149
8,061,889 B2 * 11/2011 Mattson ..... B01F 7/002 366/194
8,887,965 B2 * 11/2014 Verby ..... F16L 37/00 222/251
2004/0137144 A1 * 7/2004 Shutic ..... B05B 7/1404 427/180
2004/0206402 A1 * 10/2004 Weinberger ..... F04B 53/101 137/533.11
2005/0199135 A1 * 9/2005 Nishinomiya ..... A23G 3/021 99/472
2005/0230497 A1 * 10/2005 Gundersen ..... E04F 21/12 239/152
2007/0084946 A1 * 4/2007 Neville ..... A01C 23/047 239/172
2007/0122301 A1 * 5/2007 Schlecht ..... F04B 9/14 417/437
2009/0277975 A1 * 11/2009 Mattson ..... B01F 7/002 239/346
2014/0033910 A1 * 2/2014 Bauck ..... F04B 9/12 91/418
2014/0044567 A1 * 2/2014 Bauck ..... F04B 53/12 417/53
2018/0087492 A1 * 3/2018 Powell ..... F04B 9/045
2018/0207666 A1 * 7/2018 Horning ..... B05B 7/1445

FOREIGN PATENT DOCUMENTS

CN 102444269 A 5/2012
CN 102536787 A 7/2012
CN 206346458 U 7/2017
CN 106996182 A 8/2017
CN 107407099 A 11/2017
EP 0962258 A1 12/1999
WO WO9309878 A1 5/1993

OTHER PUBLICATIONS

Extended European Search Report for EP Application No. 18250005.8, dated May 28, 2018, 6 Pages.

* cited by examiner

MATERIAL SPRAYER HAVING SLIDING PUMP MOUNTING

BACKGROUND

The present disclosure relates to material sprayers. More particularly, the present disclosure relates to a slidable engagement of a pump with a material sprayer.

Material sprayers are used to spray fluid to build up and/or cover surfaces such as walls and ceilings, with the fluid drying in place to form a solid material. The sprayed fluids are typically viscous and can include plaster, aggregate (e.g., polystyrene or vermiculite), wall and ceiling texture materials, joint compounds, surfacing materials, acrylic materials, textured elastomeric materials, and coating materials (e.g., anti-skid floor coating materials). Material for the sprayer is typically supplied in bags or buckets, mixed with water if necessary, fed into the sprayer, placed under pressure by a pump of the sprayer, and then sprayed from a gun or other outlet.

SUMMARY

A pump for use with a material sprayer includes a cylinder, a piston disposed in the cylinder, a pump head attached to the piston, first and second check valves, and an elbow connected to the cylinder. The cylinder and the piston are coaxial with a pump axis of the pump. The pump head is configured to make a mechanical connection with the reciprocating drive mechanism so as to allow the reciprocating drive mechanism to reciprocate the piston along the pump axis. The elbow includes a first end, a second end, and an inner fluid channel. The first end is configured to make a fluid connection with the hopper. The second end is configured to be fixed with respect to the cylinder. The inner fluid channel extends from the first end to the second end and bends between the first end and the second end. The pump head and the first end of the elbow are configured to make both a mechanical connection and a fluid connection with a single linear motion of the pump.

A pump assembly for a material sprayer with a hopper and a reciprocating drive mechanism includes a pump and an elbow. The pump is configured to pressurize a fluid and is mechanically attached to the reciprocating drive mechanism and fluidly attached to the hopper. The pump includes a cylinder, a piston disposed in and slideably engaged with the cylinder, and a pump axis. The piston includes a pump head connected to the reciprocating drive mechanism. The cylinder and the piston are coaxial with the pump axis such that the piston reciprocates along the pump axis. The piston is connected to the reciprocating drive mechanism such that the piston is coaxial with and is driven by the reciprocating drive mechanism to reciprocate along the pump axis. The elbow is a bent tube configured to transport a fluid therethrough and fluidly connects the pump to the hopper. The elbow includes a first end, a second end, and a bend portion. The first end is fluidly connected to a port of the hopper. The second end of the elbow is attached to the pump on a first end of the pump opposite from the reciprocating drive mechanism. The bend portion extends between the first and second ends of the elbow. The pump assembly is configured to be attached to or detached from the hopper and the reciprocating drive mechanism with a single linear motion of the pump assembly relative to the hopper and the reciprocating drive mechanism.

A method of installing a pump assembly onto a material sprayer with a hopper and a reciprocating drive mechanism includes inserting a first end of an elbow of the pump assembly into a port of the hopper. The pump assembly includes a pump and an elbow. The pump includes a cylinder and a piston disposed in and slideably engaged with the cylinder. The piston includes a piston head. The cylinder and the piston are coaxial with the pump axis. The elbow includes the first end, a second end, and a bend portion. The second end of the elbow is attached to the pump on a first end of the pump opposite from the reciprocating drive mechanism. The bend portion of the elbow extends between the first and second ends of the elbow. The piston head is inserted into a slot of a collar of the reciprocating drive mechanism. A dynamic mechanical connection is formed between the pump and the reciprocating drive mechanism. A fluidic connection is formed between the pump and the port of the hopper.

DETAILED DESCRIPTION

Figure 1:
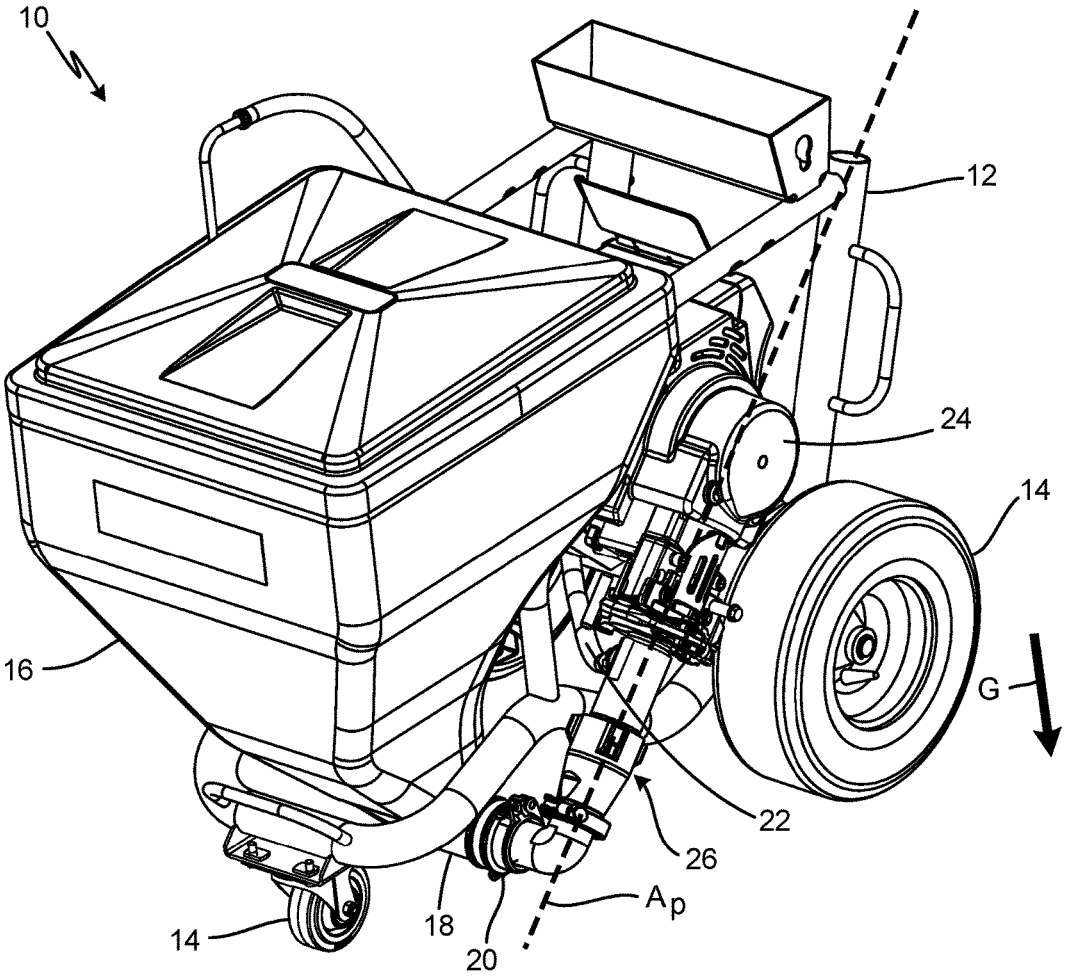
FIG. 1 is an isometric view of a material sprayer with a hopper, a reciprocating drive mechanism, and a pump assembly.

FIG. 1 is an isometric view of material sprayer 10 and shows frame 12, wheels 14, hopper 16 (with port 18), fitting 20, hose 22, reciprocating drive mechanism 24, drive assembly 26, pump axis $A_P$, and direction G of gravity. Port 18 is a fluidic outlet of hopper 16. Fitting 20 is a piece of tubing or piping that acts as a coupler. In this non-limiting embodiment, fitting 20 can be formed from a flexible material such as rubber. Hose 22 is an elongated tube for transporting a fluid. Reciprocating drive mechanism 24 is a gas, electric, pneumatic, or hydraulic powered motor. Pump assembly 26 is an assembly of mechanical devices that creates pressure to move a fluid. Pump axis $A_P$ is a centerline axis of pump assembly 26. Direction G is an approximate direction of gravity relative to the orientation of material sprayer 10.

Material sprayer 10 is a modular unit that can be maneuvered around a jobsite as needed. Frame 12 is disposed throughout material sprayer 10 and is connected to the various elements of material sprayer 10 such as wheels 14, hopper 16, pump 22, and reciprocating drive mechanism 24. Wheels 14 are mounted to frame 12 via an axle. Hopper 16 is mounted to a portion of frame 12. Port 18 is disposed on a gravitational bottom portion of hopper 16 (towards the bottom of FIG. 1). Port 18 is fluidly connected to hopper 16 and pump 10. Port 18 is also fluidly connected to a cavity of hopper 16. Fitting 20 connects port 18 of hopper 16 to pump assembly 26. Hose 22 is fluidly connected to an internal chamber of pump assembly 26. Reciprocating drive mechanism 24 is mounted to frame 12 and is mechanically connected to pump assembly 26. Pump assembly 26 is fluidly connected to port 18 of hopper 16. Pump assembly 26 is also mechanically connected to reciprocating drive mechanism 24.

Material sprayer 10 is configured to spray a pressurized fluid onto a surface. Frame 12 holds together and supports all of the elements of material sprayer 10. Wheels 14 rotate enabling material sprayer 10 to be moved around to new locations. Hopper 16 contains material within hopper 16. During operation of material sprayer 10, hopper 16 guides the material within hopper 16 in a downward direction to port 18. Port 18 transports the fluid from hopper 16 to assembly pump 26. Fitting 20 forms a fluidic seal between portions of port 18 and pump assembly 26. Hose 22 transports the pressurized fluid away from pump assembly 26 to a spray handle or other fluidic outlet. Reciprocating drive mechanism 24 is driven to cause pump assembly 26 to create a pressure within pump assembly 26. Pump assembly 26 pressurizes the fluid received from hopper 16 and delivers the pressurized fluid to hose 22.

Figure 2:
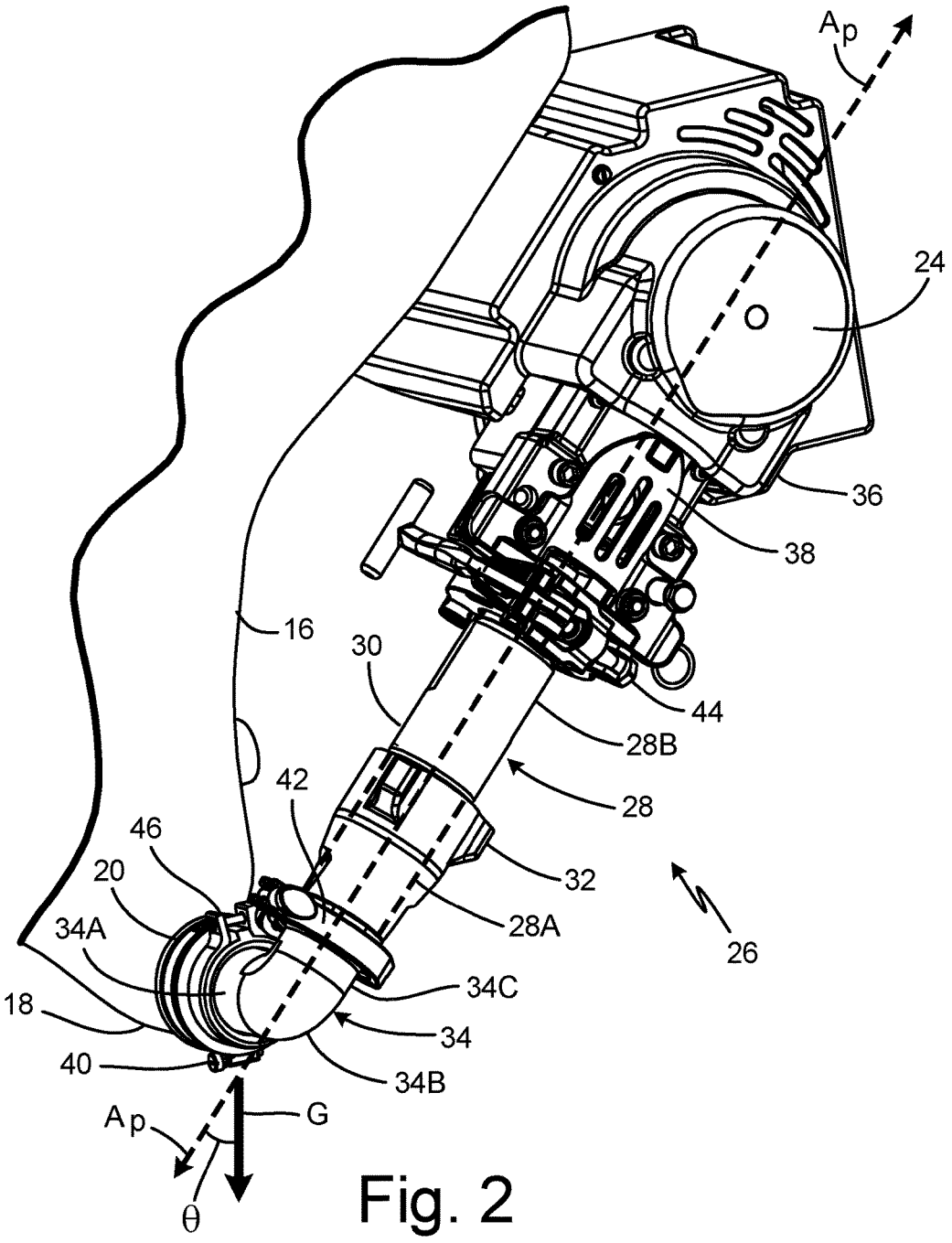
FIG. 2 is an enlarged perspective view of the reciprocating drive mechanism and the pump assembly.

FIG. 2 is an enlarged perspective view of reciprocating drive mechanism 24 and pump assembly 26 that shows hopper 16, port 18, fitting 20, reciprocating drive mechanism 24, pump assembly 26 (with pump 28, first end 28A of pump 28, second end 28B of pump 28, cylinder 30, lower section 32, elbow 34, first end 34A of elbow 34, bend portion 34B of elbow 34, second end 34C of elbow 34, pump mount frame 36, door 38, clamp 40, clamp 42, clamp 44, and clamp 46), pump axis $A_P$, direction G of gravity, and angle θ.

Pump 28 a mechanical device that creates pressure to move a fluid. In this non-limiting embodiment, pump 28 is a double displacement pump that makes use of two check valves to control the flow of fluid during operation (see e.g., FIG. 3). In another non-limiting embodiment, pump 28 can be a single displacement pump. First end 28A and second end 28B are distal ends of pump 28. Cylinder 30 and lower section 32 are tubes of solid material with passages therethrough. Elbow 34 is a curved tube with an inner fluid channel and configured to transport a fluid therethrough. In one non-limiting embodiment, elbow 34 can be formed from a polymer or a metal. First end 34A and second end 34C are ends of elbow 34. Bend portion 34B is a curved portion of elbow 34.

Pump mount frame 36 is a structural framework of solid material. Door 38 is a removable barrier of solid material. Clamps 40 and 46 are over center cam clamps, or alternatively are sanitary clamps. Clamp 42 is a sanitary clamp. Clamp 44 is a hand release clamp with a handle. In other non-limiting embodiments, any of clamps 40, 42, 44, and/or 46 can be an over center cam clamp, a sanitary clamp, or another type of releasable or non-releasable clamp. Angle θ is an angle between pump axis $A_P$ and direction G of gravity.

A first end of fitting 20 is attached to port 18 of the hopper by clamp 40. A second end of fitting 20 is attached to first end 34A of elbow 34 by clamp 46. Pump 28 is fluidly connected to elbow 34. First end 28A of pump 28 is physically connected and attached to second end 34B of elbow 34 via clamp 42. Second end 28B of pump 28 is physically connected and attached to pump mount frame 36 via clamp 44. Cylinder 30 is attached and connected to second end 34C of elbow 34 and to pump mount frame 36. Cylinder 30 surrounds and encases a piston. Lower section 32 is connected and attached to cylinder 30 and to second end 34C of elbow 34.

Elbow 34 is fluidly connected to port 18 of hopper 16 and to pump 28. The inner fluid channel of elbow 34 extends from first end 34A to second end 34C and bends between first end 34A and second end 34C. First end 34A of elbow 34 is connected and attached to port 18 of hopper 16 via fitting 20 and clamps 40 and 46. Bend portion 34B of elbow 34 is connected to and located between first and second ends 34A and 34C of elbow 34. In this non-limiting embodiment, bend portion 34B includes a bend of approximately 90 degrees. Second end 34C of elbow 34 is connected and attached to first end 28A of pump 28.

Pump mount frame 36 is rigidly attached directly or indirectly to frame 12 of material sprayer 10. Door 38 is detachably affixed to pump mount frame 36. Clamp 40 is clamped onto and around portions of fitting 20 and port 18. Clamp 42 is clamped onto and around portions of second end 34C of elbow 34 and first end 28A of pump 28. Clamp 44 is clamped onto and around portions of second end 28B of pump 28 and pump frame mount 36. Clamp 46 is clamped onto and around portions of fitting 20 and first end 34A of elbow 34. In this non-limiting embodiment, angle θ between pump axis $A_P$ and direction G of gravity is approximately 45 degrees. In other non-limiting embodiments, angle θ between pump axis $A_P$ and direction G of gravity can be approximately 15 to 65 degrees.

Fitting 20 allows for small adjustments and misalignments in the positioning of hopper 16 and elbow 34 (and pump 28 as attached to elbow 34). Pump 28 pressurizes fluid received from port 18 of hopper 16 and delivers the pressurized fluid to hose 22 (not shown in FIG. 2). Cylinder 30 contains dynamic elements of pump 28 as well as the fluid pressurized by pump 28. Lower section 32 physically and mechanically connects pump 28 to elbow 34. Elbow 34 transfers fluid from port 18 of hopper 16 to pump 28. Pump mount frame 36 stabilizes pump assembly 26 to frame 12 of material sprayer 10. Door 38 blocks access to reciprocating components of pump 28 and prevents removal of pump 28 until door 38 is removed. Clamp 40 attaches and forms a sealing interface between portions of fitting 20 and port 18. Clamp 40 is tightened over fitting 20 to secure and seal fitting 20 about port 18 of hopper 16. Clamp 40 also affixes fitting 20 and port 18 together and helps to prevent any leakage of fluid at the interface between fitting 20 and port 18.

Clamp 42 attaches and forms a sealing interface between portions of second end 34C of elbow 34 and first end 28A of pump 28. Clamp 44 attaches and forms a sealing interface between portions of second end 28B of pump 28 and pump frame mount 36. Clamp 46 attaches and forms a sealing interface between portions of fitting 20 and first end 34A of elbow 34. Clamp 46 is tightened over fitting 20 to secure and seal fitting 20 about elbow 34 to affix fitting 20 and elbow 34 together and to prevent any leakage of fluid at the interface between fitting 20 and elbow 34.

Angling pump axis $A_P$ of pump assembly 26 relative to gravity (or relative to the ground) allows for hopper 16 and pump 28 to be low to the ground to maximize compactness of material sprayer 10 and for a lower a center of mass of material sprayer 10 for increased stability, both aspects of which are useful for transporting material sprayer 10 around a jobsite. Angling pump axis $A_P$ of pump assembly 26 relative to gravity (or relative to the ground) also removes the necessity for the use of springs in check valves within pump 28 due to the ball elements of the check valves being able to seat due to the vertical component of gravity. Being able to use pump 28 without springs removes complications associated with the use of springs in check valves such as leakages, blockages, and failure of the spring(s).

Figure 3:
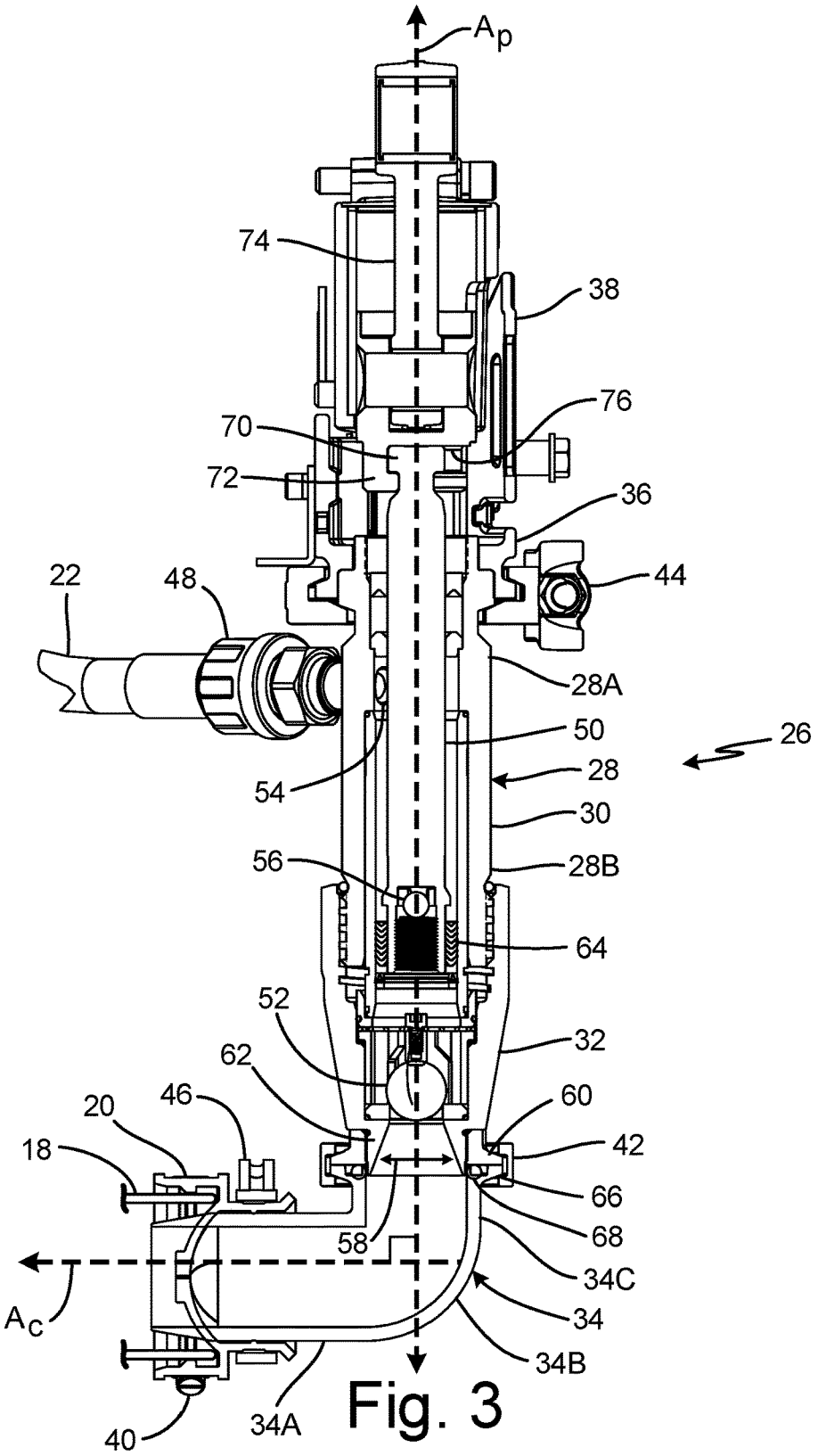
FIG. 3 is a cross-section view of a pump and an elbow of the pump assembly.

FIG. 3 is a cross-section view of pump assembly 26 and shows hopper 16 (with port 18), fitting 20, hose 22, connector 48, pump assembly 26 (with pump 28, first end 28A of pump 28, second end 28B of pump 28, cylinder 30, piston 50, first check valve 52, output port 54, lower section 32, second check valve 56, intake 58, annular flange 60, annular protrusion 62, packing ring stack 64, elbow 34, first end 34A of elbow 34, centerline axis $A_C$ of first end 34A, bend portion 34B of elbow 34, second end 34C of elbow 34, annular flange 66, O-ring 68), pump mount frame 36, head 70, collar 72, connecting arm 74, slot 76, clamp 40, clamp 42, clamp 44, clamp 46, and pump axis $A_P$.

Centerline axis $A_C$ is an axis passing through a centerpoint of first end 34A of elbow 34. Connector 48 is a device configured to connect or attach two elements together. Piston 50 is an elongated rod including features at opposite ends. In one non-limiting embodiment, a material of piston 50 can include metal. First check valve 52 and second check valve 56 are fluidic valves with balls and seats. Output port 54 is a fluidic outlet. Intake 58 is a fluidic inlet. Annular flange 60 and annular flange 66 are ring-shaped protrusions of solid material. Annular protrusion 62 is an annular extension of solid material. Packing ring stack 64 is a stack of seal rings. In other non-limiting embodiments, packing ring stack 64 can include a single seal or bushing in place of a stack of rings. O-ring 68 is a gasket. Head 70 is a distal end of piston 50. Collar 72 is a ring or band of solid material. Connecting arm 74 is an elongated piece of solid material. Slot 76 is an aperture or slit.

In this non-limiting embodiment, centerline axis $A_C$ of first end 34A is oriented at approximately 90 degrees from pump axis $A_P$. Connector 48 connects hose 22 to output port 54 of pump 28 with a threaded interface. Piston 50 is disposed in and is in slidable engagement with cylinder 30. Piston 50 is mounted to collar 72 via head 70 of piston 50. Piston 50 is coaxial (e.g., axially aligned) with pump axis $A_P$ such that piston 50 reciprocates along pump axis $A_P$. Piston 50 and cylinder 30 are coaxial with pump axis $A_P$. First check valve 52 is housed within lower section 32. Output port 54 is formed in a portion of cylinder 30 of pump 28. Output port 54 is fluidly connected to cylinder 30 and to hose 22 via connector 48. Second check valve 56 is housed within the bottom end of piston 50. In another non-limiting embodiment, second check valve 56 can be mounted onto cylinder 30 (and not on piston 50) as part of output port 54 for pump 28. Intake 58 is formed by annular protrusion 62 in lower section 32 of pump 28 and is fluidly connected to elbow 34.

Annular flanges 60 and 66 are complementally to fit flush against one another. As shown, annular flanges 60 and 66 fit within clamp 42. Annular protrusion 62 is formed by part of lower section 32 and defines a portion of the opening of intake 58 of pump 28. Annular protrusion 62 extends beyond (e.g., below) annular flange 60. Annular protrusion 62 fits inside elbow 34. Packing ring stack 64 is disposed directly between piston 50 and cylinder 30. O-ring 68 is positioned between annular flanges 60 and 66. Head 70 is located at the second end of piston 50. With piston assembly 26 engaged with reciprocating drive mechanism 24, head 70 of piston 50 is disposed or accepted within slot 76 of collar 72. Head 70 of piston 50 attaches to collar 72 of reciprocating drive mechanism 24.

Collar 72 cradles underneath head 70 of piston 50. Connecting arm 74 is physically connected to collar 72 and is mounted within a portion of pump mount frame 36. Slot 76 is disposed in a portion of collar 72. In other non-limiting embodiments, alternative mechanical elements, other than collar 72 and head 70, can connect to piston 50 to reciprocating drive mechanism 24. For example, a metal pin that extends through aligned holes in collar 72 and piston 50 can couple collar 72 and piston 50, wherein the holes extend transverse to the long axes of collar 72 and piston 50.

Clamp 42 presses and holds annular flanges 66 and 60 against one another to seal the joint between elbow 34 and pump 28 (and/or lower section 32). Connector 48 on hose 22 allows hose 22 to be attached, and easily removed, from connection with pump 28. Piston 50 linearly moves with collar 72 as driven by reciprocating drive mechanism 24 to operate pump 28. During the upstroke of piston 50, the ball of first check valve 52 is pushed off of its seat as fluid is drawn from intake 58 past the seat and ball of first check valve 52 and further into lower section 32. Also on the upstroke of piston 50, the ball is forced onto the seat of second check valve 56 to prevent fluid that has already passed through second check valve 56 from flowing backwards through second check valve 56.

On the downstroke of piston 50, the ball of first check valve 52 seals against its seat on the downstroke of piston 50 to prevent retrograde flow of fluid back through intake 58. Meanwhile on the downstroke, the ball of second check valve 56 is pushed off of its seat as fluid, having already passed by first check valve 52 on the upstroke, is forced into an intake on the face of piston 50 and through second check valve 56. Packing ring stack 64 seals between piston 50 and cylinder 30 to force the fluid through the intake on the face of piston 50.

The use of second check valve 56 in piston 50 provides for a double displacement action of pump 28, whereby pump 28 expels fluid on the upstroke of piston 50 as well as on the downstroke of piston 50. Therefore, on both of the upstrokes and down-strokes, fluid is forced through output port 54 formed in cylinder 30, outputting the pumped fluid under pressure through hose 22 for spraying by a gun or other outlet. In the non-limiting embodiment of second check valve 56 being mounted to cylinder 30, pump 28 would be a single displacement pump, sucking fluid into pump 28 on the upstroke of piston 50 and expelling the fluid from pump 28 on the downstroke of piston 50.

Annular flanges 66 and 60 engage with each other to seal the joint between elbow 34 and pump 28. Annular protrusion 62 aligns lower section 32 of pump 28 with second end 34C of elbow 34 and allows for rotational misalignment between pump 28 and elbow 34. Packing ring stack 64 seals between the dynamic surfaces of pump 28 to force fluid through intake 58 on a face of piston 50. O-ring 68 seals the interface between annular flanges 60 and 66. Pump head 70 and first end 34A of elbow 34 are configured to make both a mechanical connection and a fluid connection with a single linear motion of pump 28. During operation, collar 72 moves piston 50 up and down. Collar 72 is reciprocated by connecting arm 74. In one non-limiting embodiment, connecting arm 74 is part of a crank that connects with an eccentric rotated by motor of reciprocating drive mechanism 24 to convert rotational motion of the eccentric into a linear reciprocating motion of collar 72. In another non-limiting embodiment, a scotch yoke can convert the rotational motion of the eccentric into a linear reciprocating motion of collar 72 in order to drive piston 50. Slot 76 is configured to receive or accept head 70 of piston 50.

Figure 4A:
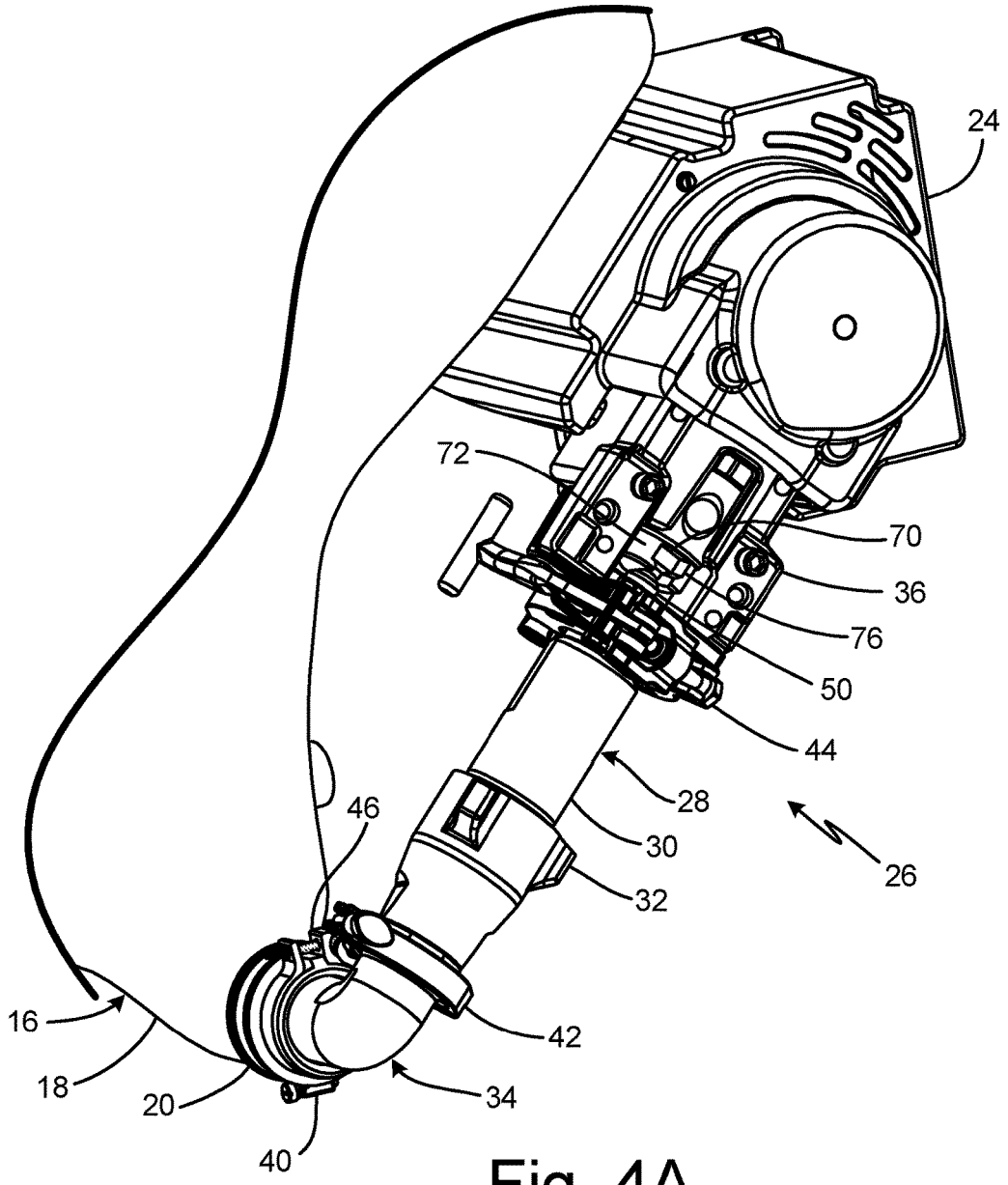
FIG. 4A is an enlarged perspective view of the pump assembly with a clamp.
Figure 4B:
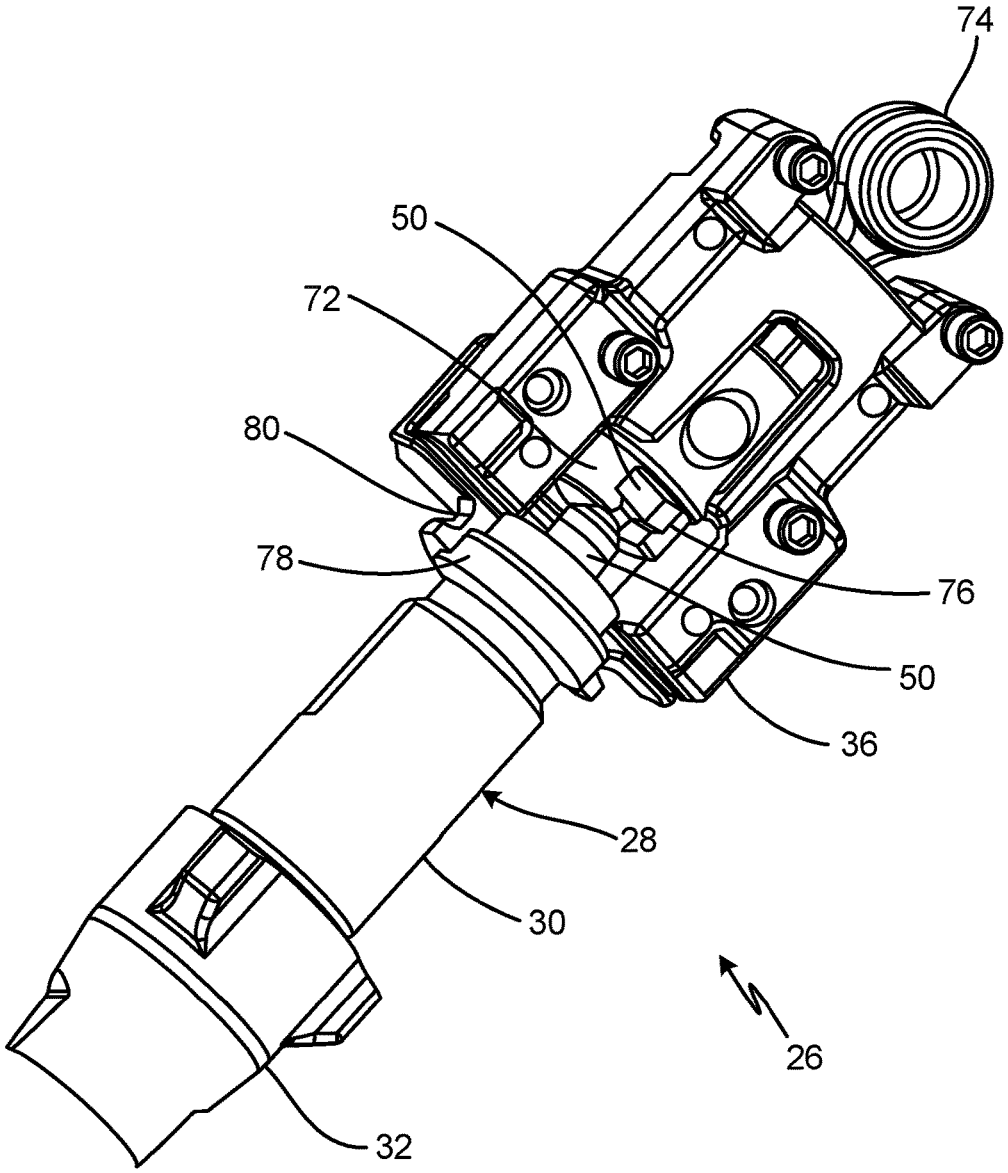
FIG. 4B is a detailed view of a portion the pump assembly with the clamp removed.

FIG. 4A is an enlarged perspective view of pump assembly 26 with door 38 removed and shows hopper 16, port 18, fitting 20, reciprocating drive mechanism 24, pump assembly 26, pump 28, cylinder 30, lower section 32, elbow 34, pump mount frame 36, clamp 40, clamp 42, clamp 44, clamp 46, head 70, collar 72, and slot 76. FIG. 4B is an enlarged detailed view of a portion of pump assembly 26 and shows the slotted engagement between head 70 and slot 76 (with reciprocating drive mechanism 24 and door 38 removed for clarity). FIG. 4B shows a portion of pump assembly 26, pump 28, cylinder 30, lower section 32, pump mount frame 36, piston 50, head 70, collar 72, connecting arm 74, slot 76, rib 78, and shelf 80. FIGS. 4A and 4B include the same or similar elements and will be discussed in unison.

Rib 78 is a ring of solid material. Shelf 80 is an annular lip or shoulder of solid material. Slot 76 receives and houses head 70 of piston 50. A shape of slot 76 matches and/or conforms to a shape of head 70 such that head 70 can be linearly translated in and out of slot 76. When inserted into slot 76, head 70 is in contact with collar 72. Rib 78 extends entirely annularly around pump 28 and radially outwards from cylinder 30. In one non-limiting embodiment, slot 76 can be formed as part of cylinder 30, or can be attached to the top end of cylinder 30. Shelf 80 is in contact with rib 78.

Each of slot 76 and pump mount frame 36 form grooves into which clamp 44 protrudes to secure pump 28 to pump mount frame 36. This interface braces pump 28 from moving while collar 72 reciprocates piston 50 within pump 28. Slot 76 also forms a receiving space configured to receive head 70 of piston 50. As head 70 inserts completely into slot 76 during installation of head 70 of pump 50 into slot 76, a dynamic mechanical connection is formed between pump 28 and reciprocating drive mechanism 24. Rib 78 mates with shelf 80 of pump mount frame 36 to brace cylinder 30 to pump mount frame 36. Clamp 44 (as shown in FIGS. 2-4A) fits over and around rib 78 and shelf 80 to hold rib 78 to shelf 80 and to secure cylinder 30 to pump mount frame 36. Shelf 80 forms a shoulder against which rib 78 is pressed.

Figure 5:
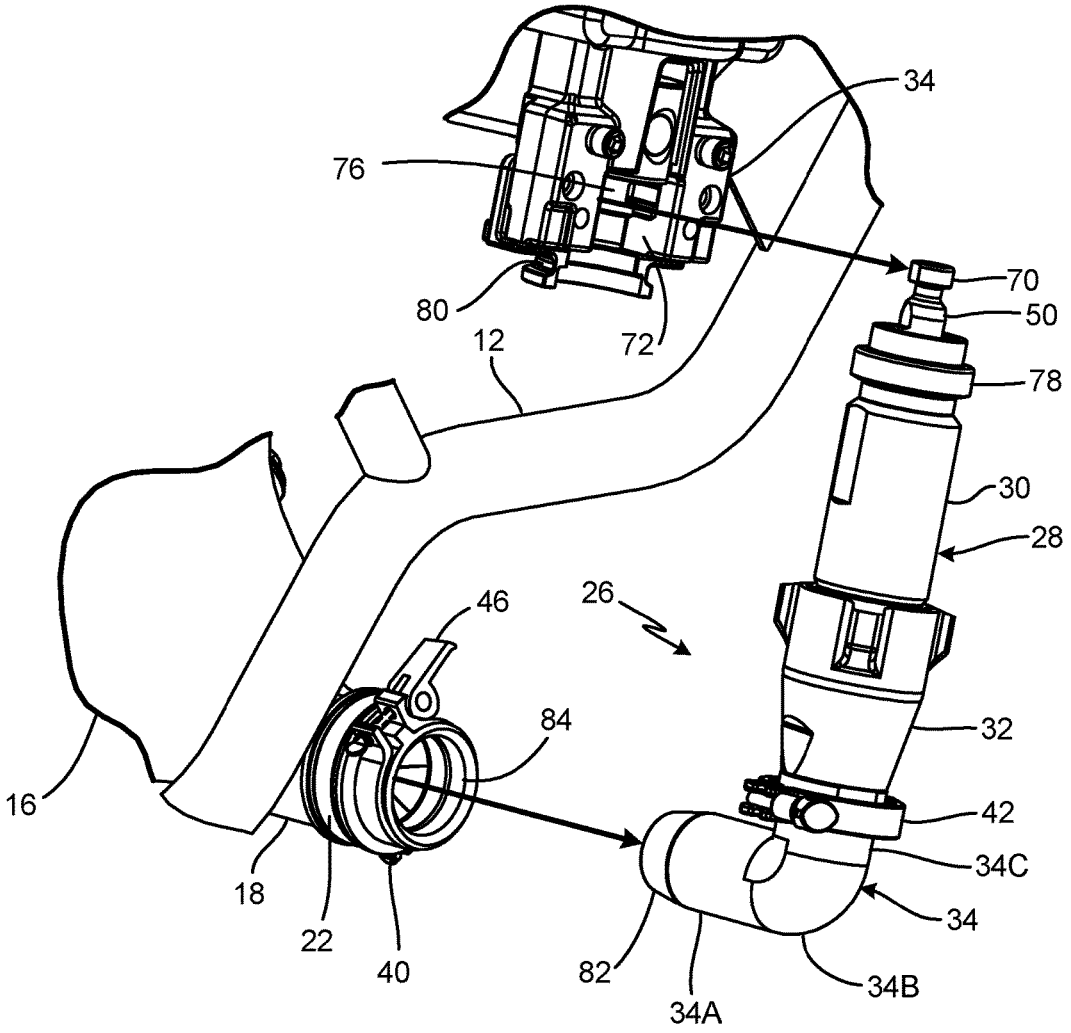
FIG. 5 is a perspective view of the pump assembly detached from the hopper and the reciprocating drive mechanism.

FIG. 5 is a perspective view of pump assembly 26 being detached from hopper 16 and reciprocating drive mechanism 24 and shows frame 12, hopper 16, port 18, fitting 20, reciprocating drive mechanism 24, pump assembly 26, pump 28, pump axis $A_P$, first end 28A of pump 28, second end 28B of pump 28, cylinder 30, lower section 32, elbow 34, first end 34A of elbow 34 (with taper end 82), bend portion 34B of elbow 34, second end 34C of elbow 34, pump mount frame 36, clamp 40, clamp 42, clamp 46, piston 50, head 70, collar 72, slot 76, rib 78, shelf 80, and opening 84. Taper end 82 is a tapered end of first end 34A of elbow 34 and is configured to be inserted into opening 84 of port 18. Opening 84 is a fluidic outlet of port 18 and is configured to receive taper end 82 of first end 34A of elbow 34.

As shown in FIG. 5, pump assembly 26 with pump 28 and elbow 34 has been removed from the rest of material sprayer 10. In one non-limiting embodiment, clamp 46 is loosened to unclamp fitting 20 from around first end 34A of elbow 34 to facilitate such removal. Pump 28 and elbow 34 slide out in a single linear motion from the mechanical connection with reciprocating drive mechanism 24 and from fitting 20, respectively. Specifically, taper end 84 of elbow 34 slides out of opening 82 of fitting 20 in the same linear motion as when head 70 of piston 50 slides out of slot 76 of collar 72. Likewise, rib 78 slides out from shelf 80 partially around which pump 28 was braced due to the same linear motion. This single linear motion breaks both the dynamic mechanical connection between reciprocating drive mechanism 24 and piston 50 and cylinder 30 as well as a fluid connection between a fluid reservoir of hopper 16 and intake 58. This linear motion is shown in reverse in the side view of FIG. 6. In one non-limiting embodiment, clamps 44 and 46 can be loosed and/or removed before the linear removal motion to remove pump assembly 26. In other non-limiting embodiments, clamps 44 and 46 may not be necessary depending on the tightness of the interfaces between taper end 84 of elbow 34 and opening 82 of fitting 20, as well as between slot 76 and/or other feature(s) of cylinder 30 and shelf 80 or other feature(s) of pump mount frame 36.

The single linear motion removal allows for quick removal of pump assembly 26 from hopper 16. If pump 28 did not remove together with elbow 34, then pump 28 would be stuck because decoupling of head 70 from collar 72 requires a linear sliding motion yet pump 28 (and lower section 32 in particular) could not be removed from elbow 34 with the same linear sliding motion. Removal of pump assembly 26 allows pump assembly 26 to be cleaned and serviced, such as disassembly of the components of pump assembly 26 and replacement of wear components, such as first and second check valves 52 and 56 and packing ring stack 64. In another non-limiting embodiment, pump assembly 26 can be removed in this single linear motion manner for replacement by a newer, cleaner, or alternatively configured pump (e.g., larger or smaller pump, as well as a pump adapted for different fluids or pressures).

Figure 6:
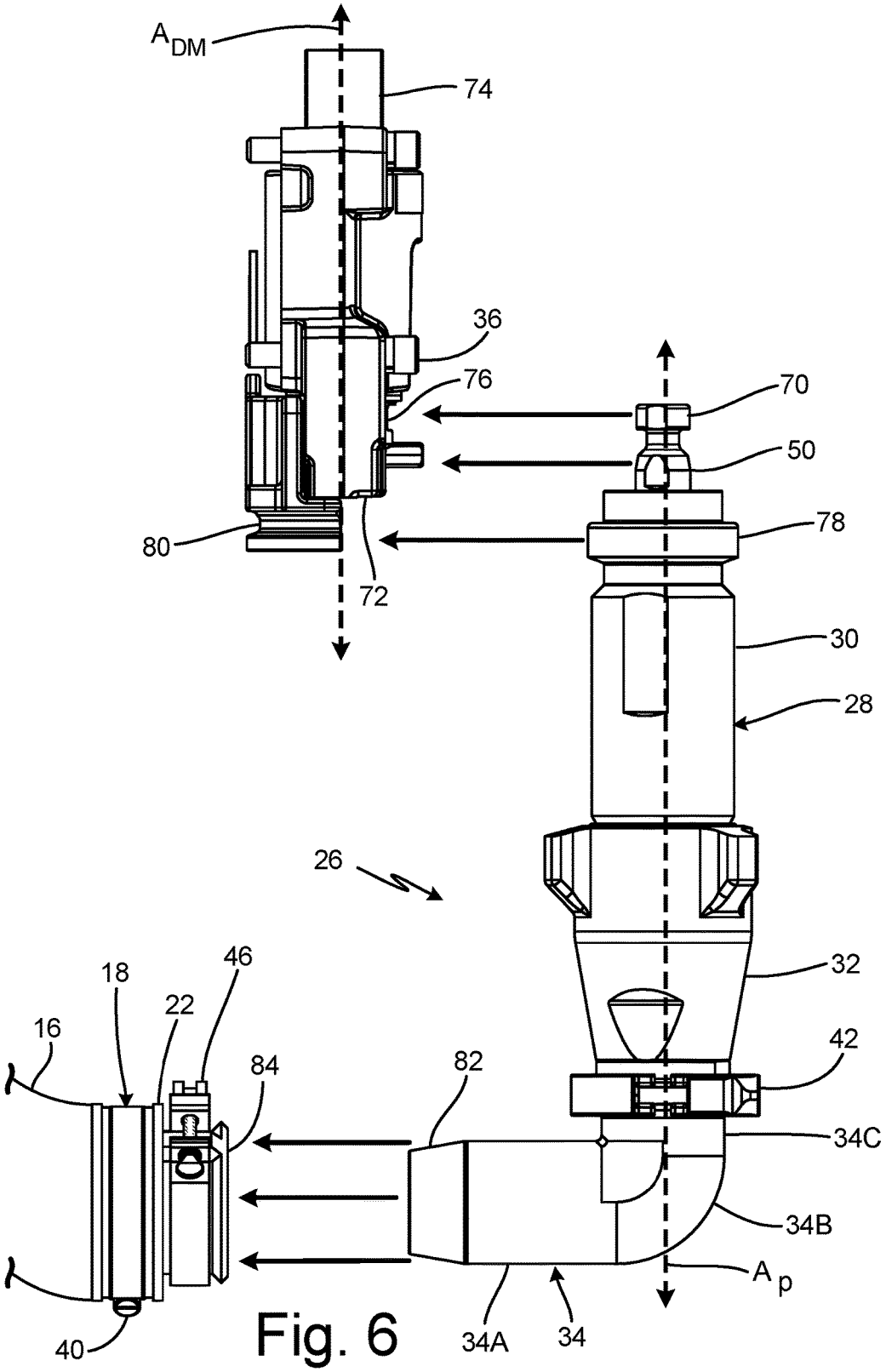
FIG. 6 is a side view of the pump assembly detached from the hopper and the reciprocating drive mechanism.

FIG. 6 is a side view of pump assembly 26 and shows pump assembly 26 moving towards hopper 16 to be reattached to hopper 16. FIG. 6 shows port 18, fitting 20, reciprocating drive mechanism 24, Axis $A_{DM}$ of reciprocating drive mechanism 24, pump assembly 26, pump 28, pump axis $A_P$, cylinder 30, lower section 32, elbow 34, first end 34A of elbow 34 (with taper end 82), bend portion 34B of elbow 34, second end 34C of elbow 34, pump mount frame 36, clamp 40, clamp 42, clamp 46, piston 50, head 70, collar 72, connecting arm 74, slot 76, rib 78, shelf 80, and opening 84. Axis $A_{DM}$ is a centerline axis of reciprocating drive mechanism 24 along which connecting arm 74 translates.

In one non-limiting embodiment, pump assembly 26 is remounted on material sprayer 10 by essentially a similar, but opposite, linear motion as described with respect to FIG. 5. Pump assembly 26 with pump 28 and elbow 34 is slid in a single linear motion to establish (or reestablish) the dynamical mechanical connection between reciprocating drive mechanism 24 and piston 50 and cylinder 30 as well as the fluid connection between the fluid reservoir of hopper 16 and intake 58 of pump 28. Specifically, taper end 84 of elbow 34 moves into opening 82 of fitting 20 in the same linear motion as when head 70 moves into slot 76 of collar 72. Likewise, rib 78 moves to mate with shelf 80. In one non-limiting embodiment, clamps 44 and 46 can be placed around pump assembly 26 and/or tightened after the linear motion to mount pump assembly 26. In some non-limiting embodiments, clamps 44 and 46 may not be necessary depending on the tightness of the interfaces between taper end 84 of elbow 34 and opening 82 of fitting 20, as well as between slot 76 and/or other feature(s) of cylinder 30 and shelf 80 or other feature(s) of pump mount frame 36.

In another non-limiting embodiment, a method of installing pump assembly 26 onto material sprayer 10 includes aligning first end 34A of elbow 34 with port 18 and aligning head 70 of piston 50 with slot 76. Pump axis $A_P$ is aligned with axis $A_{DM}$ of reciprocating drive mechanism 24. In one non-limiting embodiment, pump axis $A_P$ can be oriented at 15 to 65 degrees relative to a direction of gravity. In another non-limiting embodiment, pump axis $A_P$ can be oriented at approximately 45 degrees relative to the vertical direction of gravity. First end 34A of elbow 34 is inserted into port 18 of hopper 16. Pump assembly 26 is translated in a linear motion relative to hopper 16 and reciprocating drive mechanism 24 such that head 70 is inserted into slot 76 of collar 72 of reciprocating drive mechanism 24. Pump 28 is engaged with reciprocating drive mechanism 24 and elbow 34 is engaged with hopper 16. A dynamic mechanical connection is formed between pump 28 and reciprocating drive mechanism 24. A fluidic connection is formed between pump 28 and port 18. Port 18 is clamped to fitting 20 with clamp 40. Head 70 is clamped into slot 76 with clamp 44.

The single linear motion reconnection allows quick remounting of pump assembly 26. If pump assembly 26 did not remount together with elbow 34, then head 70 of piston 50 could not slide into slot 76 of collar 72 because lower section 32 would intersect elbow 34 or elbow 34 could not be slid into connection with each of the second end of fitting 20 (e.g., taper end 82 being received within opening 82) and first end 28A (not shown in FIG. 6) of pump 28 (these openings being 90 degrees apart).

DISCUSSION OF POSSIBLE EMBODIMENTS

The following are non-exclusive descriptions of possible embodiments of the present invention.

In a first example, a pump for use with a material sprayer includes a cylinder, a piston disposed in the cylinder, a pump head attached to the piston, first and second check valves, and an elbow connected to the cylinder. The cylinder and the piston are coaxial with a pump axis of the pump. The pump head is configured to make a mechanical connection with the reciprocating drive mechanism so as to allow the reciprocating drive mechanism to reciprocate the piston along the pump axis. The elbow includes a first end, a second end, and an inner fluid channel. The first end is configured to make a fluid connection with the hopper. The second end is configured to be fixed with respect to the cylinder. The inner fluid channel extends from the first end to the second end and bends between the first end and the second end. The pump head and the first end of the elbow are configured to make both a mechanical connection and a fluid connection with a single linear motion of the pump.

The material sprayer of the preceding paragraph can optionally include, additionally and/or alternatively, any one or more of the following features, configurations and/or additional components.

In the first example, an elbow can fluidly connect the pump to the hopper, wherein the elbow can be a bent tube configured to transport a fluid therethrough, the elbow can comprise a first end fluidly connected to a port of the hopper, a second end can be attached to the pump on an end of the pump opposite from the reciprocating drive mechanism, and/or a bend portion can extend between the first and second ends of the elbow.

In the first example, the pump axis can be oriented at an angle of approximately 45 degrees relative to the vertical direction of gravity.

In the first example, a first ball check valve can be disposed within a lower section of the pump, and/or a second ball check valve can be disposed with a portion of a first end of the piston.

In the first example, the first and second ball check valves can be orientated coaxial with the pump axis.

In the first example, the pump assembly can be configured to be attached to and/or detached from the hopper and the reciprocating drive mechanism with a single linear motion of the pump assembly relative to the hopper and the reciprocating drive mechanism.

In the first example, the single linear motion can slide the pump head into the reciprocating drive mechanism and/or can slide the first end of the elbow into a receiving port of the hopper.

In the first example, a material sprayer can have the reciprocating drive mechanism and/or the hopper.

In a second example, a pump assembly for a material sprayer with a hopper and a reciprocating drive mechanism includes a pump and an elbow. The pump is configured to pressurize a fluid and is mechanically attached to the reciprocating drive mechanism and fluidly attached to the hopper. The pump includes a cylinder, a piston disposed in and slideably engaged with the cylinder, and a pump axis. The piston includes a pump head connected to the reciprocating drive mechanism. The cylinder and the piston are coaxial with the pump axis such that the piston reciprocates along the pump axis. The piston is connected to the reciprocating drive mechanism such that the piston is coaxial with and is driven by the reciprocating drive mechanism to reciprocate along the pump axis. The elbow is a bent tube configured to transport a fluid therethrough and fluidly connects the pump to the hopper. The elbow includes a first end, a second end, and a bend portion. The first end is fluidly connected to a port of the hopper. The second end of the elbow is attached to the pump on a first end of the pump opposite from the reciprocating drive mechanism. The bend portion extends between the first and second ends of the elbow. The pump assembly is configured to be attached to or detached from the hopper and the reciprocating drive mechanism with a single linear motion of the pump assembly relative to the hopper and the reciprocating drive mechanism.

The pump assembly of the preceding paragraph can optionally include, additionally and/or alternatively, any one or more of the following features, configurations and/or additional components.

In the second example, the second end of the elbow can be coaxial with the pump axis, wherein the first end of the elbow can include a centerline axis, and wherein the centerline axis of the first end of the elbow can be oriented approximately 90 degrees relative to the pump axis.

In the second example, the first end of the elbow can include a taper such that the first end of the elbow can be configured to insert into the port of the hopper.

In the second example, the second end of the elbow can include a first flange, wherein the pump can include a second flange, wherein the first flange and the second flange can be in contact with each other, and further comprising a first clamp, wherein the first clamp can press and/or hold the first flange against the second flange.

In the second example, a lower section can be mounted to the cylinder at the first end of the pump, wherein the lower section can comprise an annular protrusion that extends into a portion of the elbow, and wherein the second flange of the pump can encircle a portion of the lower section of the pump.

In the second example, an annular fitting can include a first end and/or a second end, a second clamp can attach the first end of the annular fitting to the hopper, and/or a third clamp can attach the second end of the annular fitting to the first end of the elbow.

In a third example, a method of installing a pump assembly onto a material sprayer with a hopper and a reciprocating drive mechanism includes inserting a first end of an elbow of the pump assembly into a port of the hopper. The pump assembly includes a pump and an elbow. The pump includes a cylinder and a piston disposed in and slideably engaged with the cylinder. The piston includes a piston head. The cylinder and the piston are coaxial with the pump axis. The elbow includes the first end, a second end, and a bend portion. The second end of the elbow is attached to the pump on a first end of the pump opposite from the reciprocating drive mechanism. The bend portion of the elbow extends between the first and second ends of the elbow. The piston head is inserted into a slot of a collar of the reciprocating drive mechanism. A dynamic mechanical connection is formed between the pump and the reciprocating drive mechanism. A fluidic connection is formed between the pump and the port of the hopper.

The method of the preceding paragraph can optionally include, additionally and/or alternatively, any one or more of the following steps, features, configurations and/or additional components.

In the third example, a first end of the elbow can be aligned with a port of the hopper and/or a head of the piston of the pump can be aligned with the slot of the collar of the reciprocating drive mechanism.

In the third example, the port of the hopper can be clamped to an annular fitting that can be attached to the first end of the elbow with a first clamp and/or the head of the piston can be clamped into the slot of the collar of the reciprocating drive mechanism with a second clamp.

In the third example, an axis of the pump can be aligned with an axis of the reciprocating drive mechanism such that the axis of the pump can be coaxial with the axis of the reciprocating drive mechanism.

In the third example, the piston can be engaged with the reciprocating drive mechanism such that the reciprocating drive mechanism can be configured to reciprocate the piston along the pump axis.

In the third example, the pump assembly can be translated in a linear motion relative to the hopper and/or to the reciprocating drive mechanism to engage the pump with the reciprocating drive mechanism and/or to engage the elbow with the hopper.

In the third example, the pump axis can be oriented at 15 to 65 degrees relative to a direction of gravity.

In the third example, the pump axis can be oriented at approximately 45 degrees relative to the vertical direction of gravity.

In the third example, a tapered end of the first end of the elbow can be inserted into an opening of the port of the hopper.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A material sprayer comprising:
- a frame;
- a hopper mounted to the frame;
- a reciprocating drive mechanism mounted to the frame;
- a pump assembly with a pump fluidly attached to the hopper and attached to the reciprocating drive mechanism, wherein the pump comprises:
  - a pump axis that is oriented at an angle of 15 to 65 degrees relative to a vertical direction of gravity;
  - a piston connected to the reciprocating drive mechanism such that the piston is coaxial with the pump axis and is driven by the reciprocating drive mechanism to reciprocate along the pump axis; and
- an elbow fluidly connecting the pump to the hopper, wherein the elbow is a bent tube configured to transport a fluid therethrough, the elbow comprising:
  - a first end fluidly connected to a port of the hopper;
  - a second end attached to the pump on an end of the pump opposite from the reciprocating drive mechanism; and
  - a bend portion extending between the first and second ends of the elbow.

2. The material sprayer of claim 1, wherein the pump assembly is configured to be attached to or detached from the hopper and the reciprocating drive mechanism with a single linear motion of the pump assembly relative to the hopper and the reciprocating drive mechanism.

3. The material sprayer of claim 1, wherein the pump axis is oriented at an angle of approximately 45 degrees relative to the vertical direction of gravity.

4. The material sprayer of claim 1, wherein the pump comprises:
- a first ball check valve disposed within a lower section of the pump; and
- a second ball check valve disposed with a portion of a first end of the piston.

5. The material sprayer of claim 4, wherein the first and second ball check valves are orientated coaxial with the pump axis.

6. A material sprayer comprising:
- a frame;
- a hopper mounted to the frame;
- a reciprocating drive mechanism mounted to the frame;
- a pump assembly with a pump fluidly attached to the hopper and attached to the reciprocating drive mechanism, wherein the pump comprises:
  - a pump axis that is oriented at an angle of 15 to 65 degrees relative to a vertical direction of gravity;
  - a cylinder coaxial with the pump axis;
  - a piston disposed in the cylinder and connected to the reciprocating drive mechanism such that the piston is coaxial with the pump axis and is driven by the reciprocating drive mechanism to reciprocate along the pump axis, wherein the piston is disposed in the cylinder, wherein both the cylinder and the piston are coaxial with the pump axis;
  - a first check valve;
  - a second check valve; and
  - an elbow connected to the cylinder, the elbow having a first end configured to make a fluid connection with the hopper, a second end configured to be fixed with respect to the cylinder, and an inner fluid channel extending from the first end to the second end and bending between the first end and the second end, wherein the pump head and the first end of the elbow are configured to make both of the mechanical connection and the fluid connection with a single linear motion of the pump.

7. The material sprayer of claim 6, wherein the single linear motion slides the pump head into the reciprocating drive mechanism and slides the first end of the elbow into a receiving port of the hopper.

8. The material sprayer of claim 6, further comprising a material sprayer having the reciprocating drive mechanism and the hopper.

9. The material sprayer from claim 6, wherein the second end of the elbow is coaxial with the pump axis, wherein the first end of the elbow includes a centerline axis, and wherein the centerline axis of the first end of the elbow is oriented approximately 90 degrees relative to the pump axis.

10. The material sprayer from claim 6, wherein the first end of the elbow includes a taper such that the first end of the elbow is configured to insert into the port of the hopper.

11. The material sprayer from claim 6, further comprising:

an annular fitting with a first end and a second end;

a second clamp that attaches the first end of the annular fitting to the hopper; and a third clamp that attaches the second end of the annular fitting to the first end of the elbow.

12. The material sprayer from claim 6, wherein the second end of the elbow includes a first flange, wherein the pump includes a second flange, wherein the first flange and the second flange are in contact with each other, and further comprising a first clamp, wherein the first clamp presses and holds the first flange against the second flange.

13. The material sprayer from claim 12, wherein the pump further comprises a lower section mounted to the cylinder at the first end of the pump, wherein the lower section comprises an annular protrusion that extends into a portion of the elbow, and wherein the second flange of the pump encircles a portion of the lower section of the pump.

14. A method of installing a pump assembly onto a material sprayer, the method comprising:

providing the material sprayer, wherein the material sprayer comprises:

a frame;

a hopper mounted to the frame;

a reciprocating drive mechanism mounted to the frame;

a pump assembly with a pump fluidly attached to the hopper and attached to the reciprocating drive mechanism, wherein the pump comprises:

a pump axis that is oriented at an angle of 15 to 65 degrees relative to a vertical direction of gravity; and a piston connected to the reciprocating drive mechanism such that the piston is coaxial with the pump axis and is driven by the reciprocating drive mechanism to reciprocate along the pump axis;

inserting a first end of an elbow of the pump assembly into a port of the hopper, wherein the pump assembly comprises:

a pump comprising:

a cylinder;

the piston disposed in the cylinder, the piston comprising a piston head; and the pump axis, wherein the cylinder and the piston are coaxial with the pump axis; and an elbow comprising:

the first end;

a second end attached to the pump on a first end of the pump opposite from the reciprocating drive mechanism; and a bend portion extending between the first and second ends of the elbow;

inserting the piston head into a slot of a collar of the reciprocating drive mechanism to form a dynamic mechanical connection between the pump and the reciprocating drive mechanism; and forming a fluidic connection between the pump and the port of the hopper.

15. The method of claim 14, further comprising:

clamping the port of the hopper to an annular fitting that is attached to the first end of the elbow with a first clamp; and clamping the head of the piston into the slot of the collar of the reciprocating drive mechanism with a second clamp.

16. The method of claim 14, wherein forming the dynamic mechanical connection between the pump and the reciprocating drive mechanism further comprises engaging the piston with the reciprocating drive mechanism such that the reciprocating drive mechanism is configured to reciprocate the piston along the pump axis.

17. The method of claim 14, further comprising translating the pump assembly in a linear motion relative to the hopper and the reciprocating drive mechanism to engage the pump with the reciprocating drive mechanism and to engage the elbow with the hopper.

18. The method of claim 14, wherein inserting a first end of an elbow of the pump assembly into a port of the hopper comprises inserting a tapered end of the first end of the elbow into an opening of the port of the hopper.

19. A material sprayer comprising:

a frame;

a hopper mounted to the frame;

a reciprocating drive mechanism mounted to the frame;

a pump assembly with a pump fluidly attached to the hopper and attached to the reciprocating drive mechanism, wherein the pump comprises:

a pump axis that is oriented at an angle of 15 to 65 degrees relative to a vertical direction of gravity;

a piston connected to the reciprocating drive mechanism such that the piston is coaxial with the pump axis and is driven by the reciprocating drive mechanism to reciprocate along the pump axis;

a first ball check valve disposed within a lower section of the pump; and a second ball check valve disposed with a portion of a first end of the piston.

20. The material sprayer of claim 19, wherein the first ball check valve does not include a spring, wherein the second ball check valve does not include a spring.

* * * * *